US008215263B2

(12) United States Patent
Chuang

(10) Patent No.: US 8,215,263 B2
(45) Date of Patent: Jul. 10, 2012

(54) ADHESIVE DISPENSER WITH TEMPERATURE CONTROLLER

(75) Inventor: Hsin-Hung Chuang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 682 days.

(21) Appl. No.: 12/272,916

(22) Filed: Nov. 18, 2008

(65) Prior Publication Data

US 2009/0277383 A1 Nov. 12, 2009

(30) Foreign Application Priority Data

May 6, 2008 (CN) ..... 2008 1 0301441

(51) Int. Cl.

| | |
|---|---|
| ***B05C 11/00*** | (2006.01) |
| ***B05B 7/06*** | (2006.01) |
| ***B05B 7/16*** | (2006.01) |
| ***B41J 2/175*** | (2006.01) |
| ***B41J 29/38*** | (2006.01) |

(52) U.S. Cl. ..... 118/667; 118/666; 118/313; 118/315; 118/302

(58) Field of Classification Search ..... 118/666, 118/667, 313–315, 302; 427/427.1, 427.2, 427/8, 9; 347/88, 17, 18

See application file for complete search history.

(56) References Cited

U.S. PATENT DOCUMENTS

| | | | | |
|---|---|---|---|---|
| 6,025,012 | A * | 2/2000 | Matsuda et al. | 427/9 |
| 2001/0011510 | A1 * | 8/2001 | Koehler | 101/350.1 |
| 2002/0063762 | A1 * | 5/2002 | Haan et al. | 347/88 |
| 2004/0246309 | A1 * | 12/2004 | Watanabe | 347/55 |
| 2005/0133616 | A1 * | 6/2005 | Shimoda et al. | 239/135 |
| 2005/0231551 | A1 * | 10/2005 | Gibson et al. | 347/45 |
| 2006/0246212 | A1 * | 11/2006 | Takahashi et al. | 427/8 |

FOREIGN PATENT DOCUMENTS

| | | | |
|---|---|---|---|
| CN | 1535823 | A | 10/2004 |
| CN | 101038358 | A | 9/2007 |

* cited by examiner

*Primary Examiner* — Yewebdar Tadesse
(74) *Attorney, Agent, or Firm* — Altis Law Group, Inc.

(57) ABSTRACT

An exemplary adhesive dispenser includes a container configured for supplying an adhesive, a plurality of nozzles configured for dispensing the adhesive, and a temperature controller connected between the container and the nozzles. The temperature controller has a chamber defined therein, and the chamber is configured for accommodating the adhesive. The container and each nozzle communicate with the chamber respectively. The temperature controller is configured for maintaining the adhesive therein in a predetermined temperature.

3 Claims, 2 Drawing Sheets

ADHESIVE DISPENSER WITH TEMPERATURE CONTROLLER

BACKGROUND

1. Technical Field

The present invention relates generally to dispensers for glue, adhesive, or the like.

2. Description of Related Art

Nowadays, lens modules have been widely employed in various electronic devices (e.g., mobile phones) for image capturing. Generally, a lens module includes a lens barrel, a lens group, a spacer, and a filter (e.g., IR-cut filter). In assembly, the lens group, the spacer and the filter are assembled into the lens barrel and arranged along an optical axis thereof, in an order from an object side to an image side of the lens module. The filter is bonded with the spacer via an adhesive. The adhesive is deposited on a bonding surface of the spacer by an adhesive dispenser. After the filter coupled to the spacer via the adhesive, the lens module is placed into an oven, and then baked to achieve a complete solidification. Thus, the filter is firmly attached to the spacer. However, the baking and solidification processes are usually time-consuming. Accordingly, the efficiency of assembling the lens module is low.

Therefore, a new adhesive dispenser is desired to overcome the above mentioned problems.

SUMMARY

An exemplary adhesive dispenser includes a container configured for supplying an adhesive, a plurality of nozzles configured for dispensing the adhesive, and a temperature controller connected between the container and the nozzles. The temperature controller has a chamber defined therein, and the chamber is configured for accommodating the adhesive. The container and each nozzle communicate with the chamber respectively. The temperature controller is configured for maintaining the adhesive therein in a predetermined temperature.

BRIEF DESCRIPTION OF THE DRAWINGS

Many aspects of the embodiment can be better understood with references to the following drawings. The components in the drawings are not necessarily drawn to scale, the emphasis instead being placed upon clearly illustrating the principles of the present embodiment. Moreover, in the drawings, like reference numerals designate corresponding parts throughout the several views.

DETAILED DESCRIPTION OF THE EMBODIMENT

Figure 1:
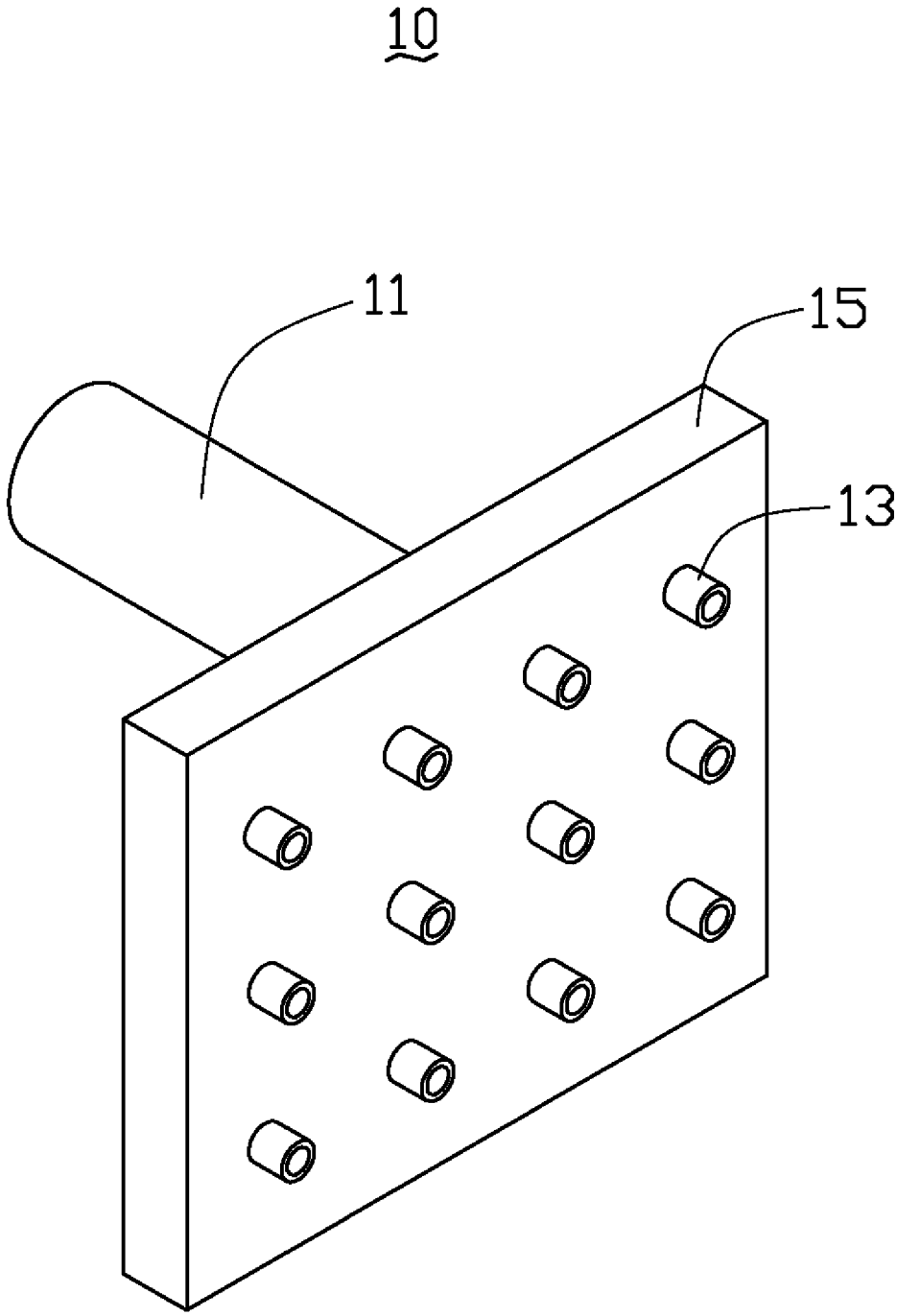
FIG. 1 is a schematic, isometric view of an adhesive dispenser, according to an exemplary embodiment.

The embodiment will now be described in detail below with reference to the drawing.

Figure 2:
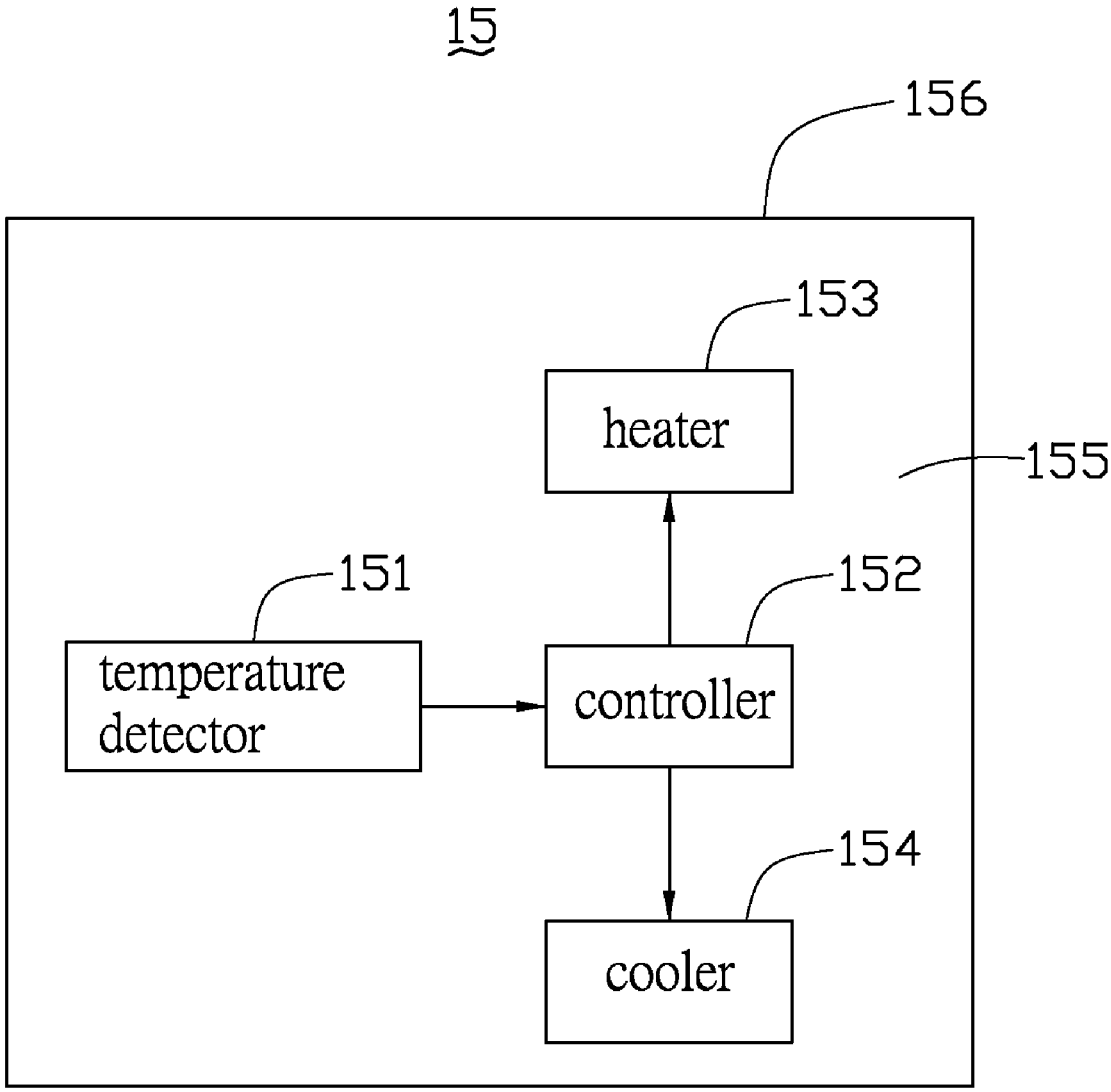
FIG. 2 is a schematic view of a temperature controller of the adhesive dispenser of FIG. 1.

Referring to FIGS. 1-2, an adhesive dispenser 10 according to an exemplary embodiment is shown. The adhesive dispenser 10 includes a container 11, a plurality of nozzles 13, and a temperature controller 15 connected between the container 11 and the nozzles 13. The container 11 is a hollow cylinder and is configured for supplying adhesive to the nozzles 13.

The temperature controller 15 is configured for maintaining the adhesive therein in a predetermined temperature. The temperature controller 15 includes a box 156, a temperature detector 151, a controller 152, a heater 153, and a cooler 154.

The box 156 is square shaped. The temperature detector 151, the heater 153, and the cooler 154 are electrically connected with the controller 152. The box 156 defines a chamber 155 therein. The temperature detector 151, the controller 152, the heater 153 and the cooler 154 are received in the chamber 155 of the box 156. The nozzles 13 are arranged on the box 156 in an array. Each nozzle 13 and the container 11 communicate with the chamber 155.

The temperature detector 151 is configured for measuring the temperature of the adhesive in the temperature controller 15. The temperature detector 151 can be a thermal couple. The heater 153 is configured for heating the adhesive in the temperature controller 15. The heater 153 can be a resistance heater. The cooler 154 is configured for cooling the adhesive in the temperature controller 15.

In operation, the temperature detector 151 detects the temperature of the adhesive in the temperature controller 15 and sends a corresponding signal to the controller 152. The controller 152 receives the signal, and compares the temperature of the adhesive with the predetermined temperature. When the temperature of the adhesive is lower than the predetermined temperature, the controller 152 turns on the heater 153, and then the heater 153 heats the adhesive up to the predetermined temperature. When the temperature of the adhesive is higher than the predetermined temperature, the controller 152 turns on the cooler 154, and then the cooler 154 cools the adhesive down to the predetermined temperature. In this way, the adhesive in the temperature controller 15 can be kept at the predetermined temperature. The adhesive in the temperature controller 15 is pre-solidified at the predetermined temperature. Therefore, it takes less time to bake and solidify the adhesive in a later process.

While certain embodiments have been described and exemplified above, various other embodiments from the foregoing disclosure will be apparent to those skilled in the art. The present invention is not limited to the particular embodiments described and exemplified but is capable of considerable variation and modification without departure from the scope of the appended claims.

What is claimed is:

1. A liquid adhesive dispenser comprising:

a container containing an adhesive placed in the container in liquid form;

a plurality of nozzles; and a temperature controller connected between the container and the nozzles, the temperature controller comprising a box, a temperature detector, a controller, a heater and a cooler, the box having a chamber defined therein, the chamber accommodating the liquid adhesive, the container and each nozzle communicating with the chamber, the temperature detector, the heater and the cooler being electrically connected with the controller, and all being received in the chamber, the temperature detector measuring the temperature of the liquid adhesive in the chamber, the controller turning on or off each of the heater and the cooler according to the temperature of the liquid adhesive in the chamber for maintaining the liquid adhesive therein at a predetermined temperature in the chamber and that prevents solidifying of the liquid adhesive, the nozzles dispensing the liquid adhesive.

2. The liquid adhesive dispenser as claimed in claim 1, wherein the nozzles are arranged on the box in an array.

3. The liquid adhesive dispenser as claimed in claim 1, wherein the container is a hollow cylinder.

* * * * *